US005529224A

United States Patent [19]

Chan et al.

[11] Patent Number: 5,529,224

[45] Date of Patent: Jun. 25, 1996

[54] SELF-CLOSING LIQUID DISPENSING PACKAGE

[75] Inventors: John G. Chan, Hyogo; Tatsuya Taniguchi, Honmachi, both of Japan

[73] Assignee: The Procter & Gamble Company, Cincinnati, Ohio

[21] Appl. No.: 250,737

[22] Filed: May 27, 1994

Related U.S. Application Data

[63] Continuation-in-part of Ser. No. 146,676, Nov. 3, 1993, abandoned.

[51] Int. Cl.[6] ..... B65D 37/00

[52] U.S. Cl. ..... 222/212; 222/107; 222/494

[58] Field of Search ..... 222/107, 105, 222/212, 490, 494

[56] References Cited

U.S. PATENT DOCUMENTS

| | | | |
|---|---|---|---|
| 2,546,709 | 3/1951 | Abarr | 222/490 X |
| 3,184,121 | 5/1965 | Volckening | 222/213 |
| 3,815,794 | 6/1974 | Carlisle | 222/491 |
| 3,913,734 | 10/1975 | Siegel | 206/498 |
| 3,917,116 | 11/1975 | Mason | 222/92 |
| 4,163,509 | 8/1979 | Amneus | 222/95 |
| 4,252,257 | 2/1981 | Herzig | 222/213 |
| 4,301,923 | 11/1981 | Vuorento | 206/484 |
| 4,657,159 | 4/1987 | Grant | 222/83 |
| 4,792,060 | 12/1988 | Brogli | 222/107 |
| 4,797,309 | 1/1989 | Kammerer et al. | 428/35.3 |
| 4,917,267 | 4/1990 | Laverdure | 222/107 |
| 4,988,016 | 1/1991 | Hawkins et al. | 222/92 |
| 5,000,350 | 3/1991 | Thomsen | 222/103 |
| 5,018,646 | 5/1991 | Billman et al. | 222/107 |
| 5,238,157 | 8/1993 | Gentile | 222/107 X |
| 5,411,178 | 5/1995 | Roders et al. | 222/107 X |

FOREIGN PATENT DOCUMENTS

| | | | |
|---|---|---|---|
| 1240961 | 8/1988 | Canada | B65D 35/00 |
| 2707841A1 | 2/1977 | Germany | B65D 83/00 |

*Primary Examiner*—Gregory L. Huson

*Attorney, Agent, or Firm*—Ronald W. Kock; Michael E. Hilton

[57] ABSTRACT

A self-closing liquid dispensing package comprises a liquid container and a self-closing flat channel valve. The channel valve has an inlet adjacent to and in liquid communication with the liquid container. It also has a mouth, a first sheet member, and a second sheet member wherein the first and second sheet members have an original planar position and longitudinal edges, are indexed face-to-face, and are sealed together along longitudinal edges and wherein the first and second sheet members are sufficiently flexible to arch away from each other to form a flow channel therebetween to permit a flow of contained liquid in response to external pressure applied to the liquid container. At least one of the sheet members is sufficiently resilient to return the first and second sheet members to the original planar position when the external pressure is released. A lateral width of the inlet is greater than a lateral width of the mouth, and the self-closing flat channel valve has an additional portion between the inlet and the mouth which has a lateral width greater than the lateral width of the inlet and the lateral width of the mouth.

7 Claims, 16 Drawing Sheets

SELF-CLOSING LIQUID DISPENSING PACKAGE

CROSS-REFERENCE TO RELATED APPLICATION

This is a continuation-in-part of my prior application, Ser. No. 08/146,676 entitled SELF-CLOSING LIQUID DISPENSING PACKAGE, filed on Nov. 3, 1993, which was expressly abandoned on Dec. 19, 1994.

TECHNICAL FIELD

The present invention relates to a self-closing liquid dispensing package for multiple use having improved dispensing and re-closing performance. The package is useful for containing various liquid products having a wide range of viscosity.

BACKGROUND

Disposable pouch-type packages made of two layers of flexible material for single-use of liquid products are prevalent in the present consumer product market. These packages are generally torn open or cut on an edge to form the dispensing opening. If the total amount of the contained liquid is not used, the rest of the liquid cannot be stored because the container itself cannot retain its shape and lacks closure means.

Pouch-type packages having self-closing functions are also known. Among these packages are those which comprise a dispensing valve made by face-to-face flexible material which can self-close itself to some extent when the squeezing pressure is released from the package, and thus can be used for multiple dispensing.

Conventional self-closing pouch-type packages are typically made of flexible film material which take a sachet-like or pillow-like bulging shape when filled with liquid. Each flexible material consists of a liquid container portion integral with a valve portion, joined along a line of connection. Typically, the shape of the package itself is not structured. Rather, the shape of these packages results from the internal pressure from the weight of the liquid contained therein, and is deformed when force is applied to the package by manual squeezing for dispensing purposes. Such deformation is not completely satisfactory for dispensing and re-closing performance of the package. First, such pouch-type package is flabby and thus difficult to hold upon dispensing. Second, the configuration of the connection portion between the liquid container and valve can constantly change depending on the amount of liquid in the container, or the amount of pressure applied, or both, thereby changing the condition of flow of the liquid. This causes difficulty to control the flow and amount of liquid to dispense. In particular, pouch-type packages made of thin flexible material cannot direct the pressure effectively to the valve for good liquid dispensing, but rather the pressure is dispersed to the surfaces of the liquid containers. Because of the difficulty to hold the package and to control amount of liquid to dispense, these packages can require use of both hands for dispensing. Third, due to changing of the shape and angle of the connection portion between the fluid container and valve, the stream of liquid cannot be cut off sharply and quickly at the valve. Fourth, the closure of these sachet-like or pillow-like packages are not sufficiently tight such that the contained liquid gradually leaks out after the package is re-closed because of liquid pressure against the valve due to the weight of the contained fluid.

Some of these self-closing pouch-type products have elongated valves which form a narrow, curved, or bent nozzle-like spout with an elongated flow channel. However, dispensing liquid through such elongated spout requires greater squeezing force and thus it can be difficult to control the flow and amount of liquid to dispense. Once liquid is dispensed through the spout, small amount of liquid can be trapped in the flow channel along the entire length of the elongated spout. This trapped liquid contributes to a substantial surface tension along the length of the flow channel, which increases the amount of squeezing force required to re-open the valve to dispense liquid. Further, it is difficult to dispense paste-type or gel-type high viscosity liquids with these packages, because of the greater friction from the inner surface of the narrow elongated spout which significantly increases the required manual squeezing force. These spouts can only practically be used for low viscosity liquids.

Thus, there is a desire to provide a self-closing dispensing package having improved dispensing and re-closing performance over known pouch-type packages.

Squeezable rigid bottle and tube packages comprising additional closing assemblies have good dispensing and closing characters. However, these packages require various surface preparations to make the rigid structure as well as the additional closing assembly, and add to the expense of these packages. Further, when the rigidity of the package is such that the package cannot be collapsed as the contents decrease, the liquid cannot be completely dispensed and used. Particularly, when the packages are made to contain small amount of liquid, the cost of the package in proportion to the total cost of the product becomes very high, and a substantial portion of the liquid remains unused. Moreover, because of the rigidity and relatively more material used to make these rigid structures, the amount of waste made when packages are disposed are relatively larger than the pouch-type packages as mentioned above.

Thus, there is also a desire to provide a dispensing package which is made by less material than rigid structured packages and which is collapsible to allow substantially complete dispensing of the contained liquid and thereby makes less product and package material waste, but without substantially sacrificing dispensing and re-closing performance.

OBJECT OF INVENTION

It is an object of the present invention to provide a self-closing liquid dispensing package useful for multiple use of liquid having a wide range of viscosity.

It is also an object of the present invention to provide a self-closing liquid dispensing package having improved dispensing and re-closing performance such as; good holding of the package, dispensing with less manual squeezing force, better control over the amount to be dispensed, sharp re-closing, tight closure after re-closing, and easy re-opening.

It is also an object of the present invention to provide a self-closing liquid dispensing package having a liquid container and a flange which can be designed easily by thermoforming; thus enabling the addition of useful functions such as sealing means, tearing means, suspensory means, and capping means.

It is further an object of the present invention to provide a self-closing liquid dispensing package made from significantly less material than rigid bottles and tubes.

It is further an object of the present invention to provide a self-closing liquid dispensing package which can dispense the contained liquid nearly completely, and can be collapsed easily as the amount of contained liquid decreases.

These objects as well as other objects can be achieved by use of the invention described.

SUMMARY OF THE INVENTION

The present invention relates to a self-closing liquid dispensing package comprising a liquid container and a self-closing flat channel valve in liquid communication with the container, wherein the liquid container comprises a reservoir portion for containing liquid, the reservoir portion made of a thermoformed thermoplastic material.

In one preferred embodiment of the present invention, the flat channel valve is in liquid communication with the container, and comprises a first sheet member and a second sheet member wherein the sheets are substantially planar, are indexed face-to-face, and are sealed together along their longitudinal edges, wherein the sheets are sufficiently flexible to arch away from each other to form a flow channel therethrough to permit a flow of contained liquid in response to external pressure applied to the liquid container, and wherein at least one of the sheets is sufficiently resilient to return the sheets to their original planar position when the external pressure is released.

In another preferred embodiment of the present invention, the flat channel valve is in liquid communication with the container via a connection portion wherein the connection portion comprises a stiffening crease.

The package of the present invention is useful for multiple use of various liquid products having a wide range of viscosity. Although the package of the present invention is primarily useful as a multiple-use disposable package, it can also be re-filled and re-used.

Figure 20:
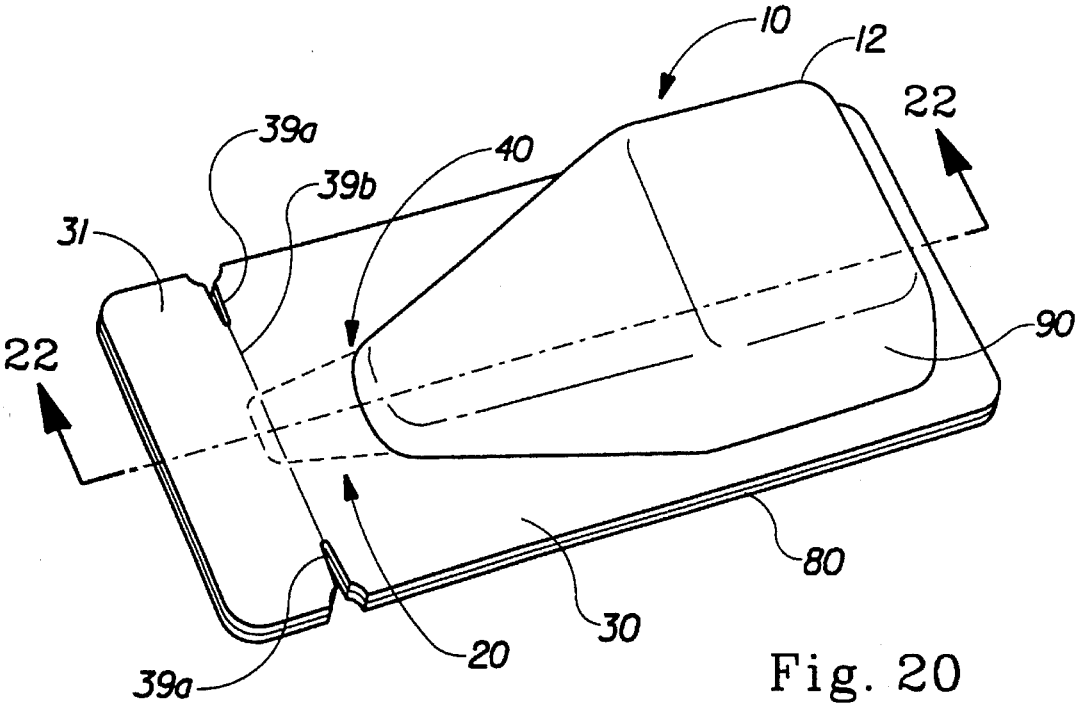
Figure 21:
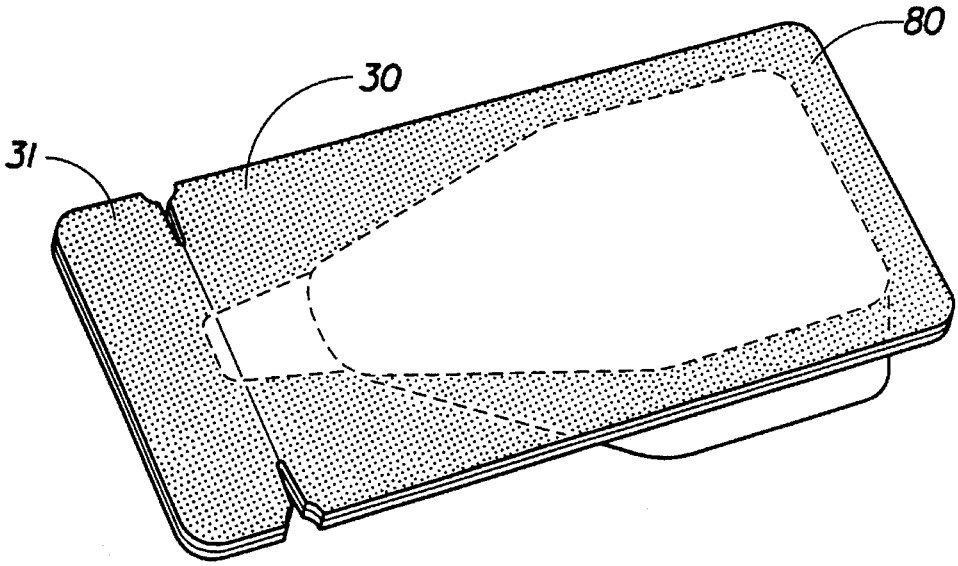

Each of FIGS. 20 and 21 is a perspective view of another package of the present invention.

Figure 22:
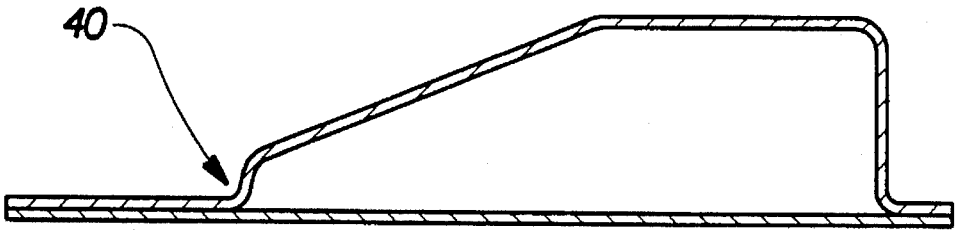

FIG. 22 is a cross sectional view along section line 22—22 of the package of FIG. 20.

Figure 23:
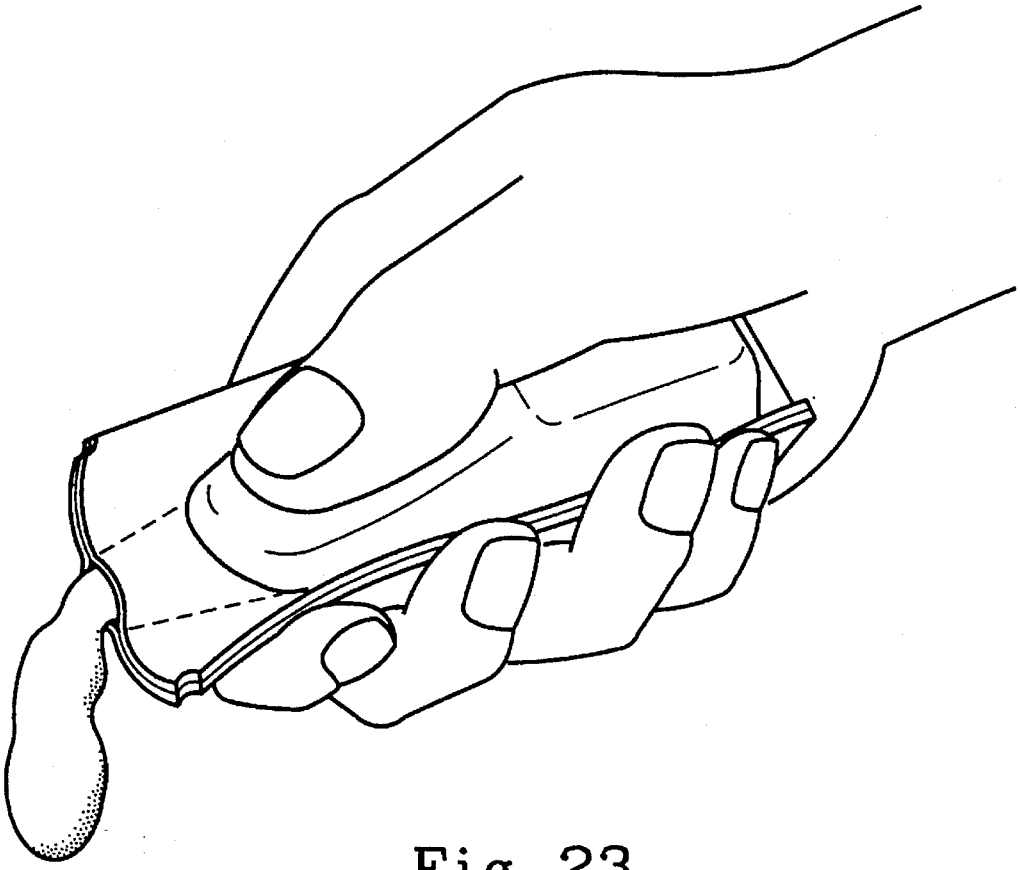

FIG. 23 is a perspective view for showing the use of the package of FIG. 20.

Figure 24:
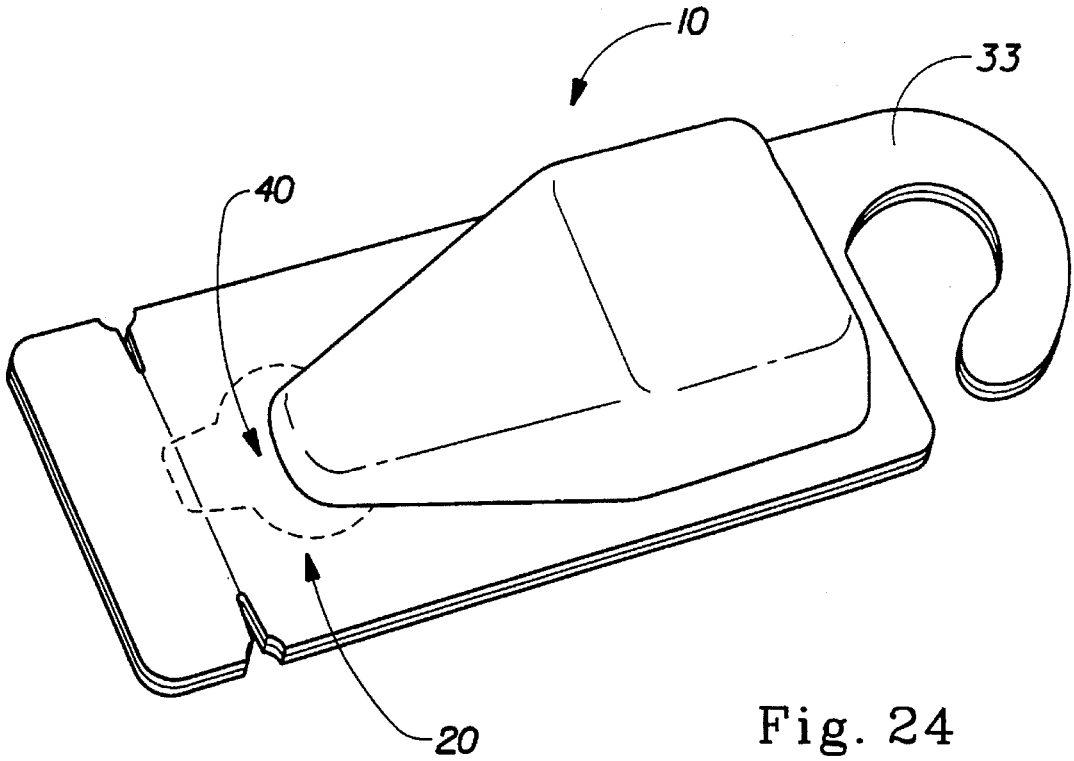
Figure 25:
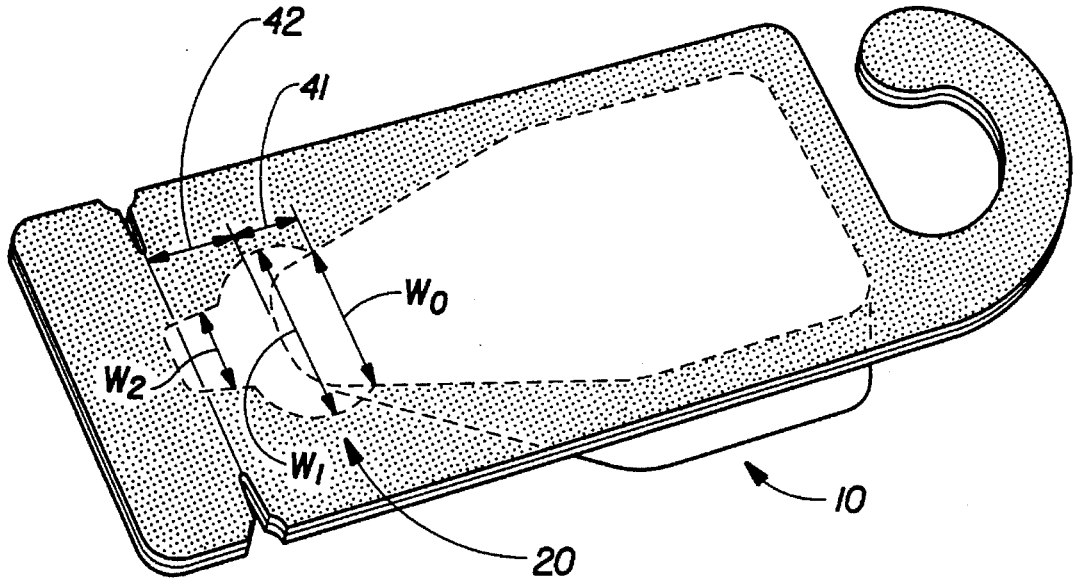

Each of FIGS. 24 and 25 is a perspective view of another package of the present invention.

Figure 26:
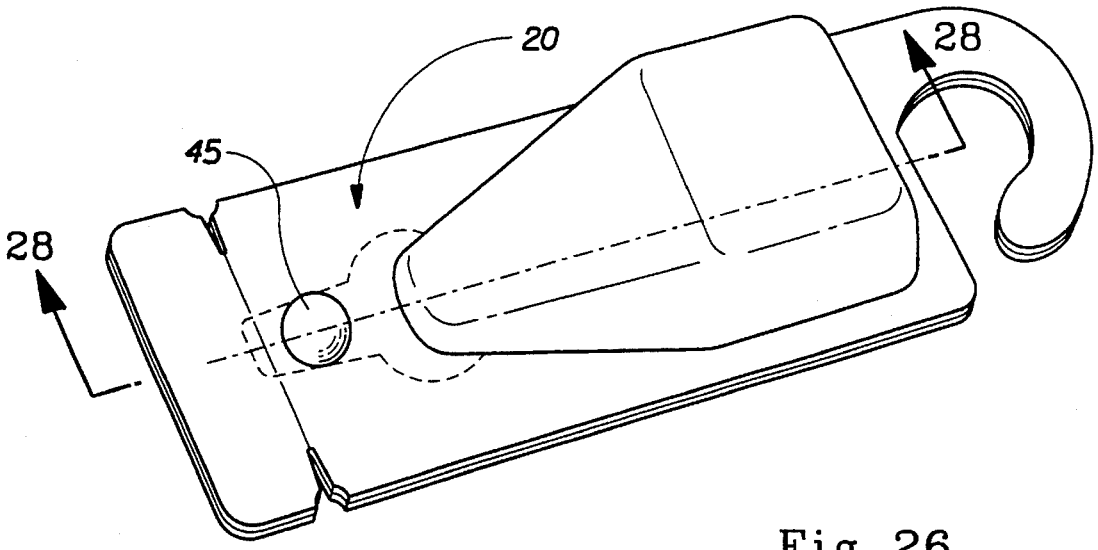
Figure 27:
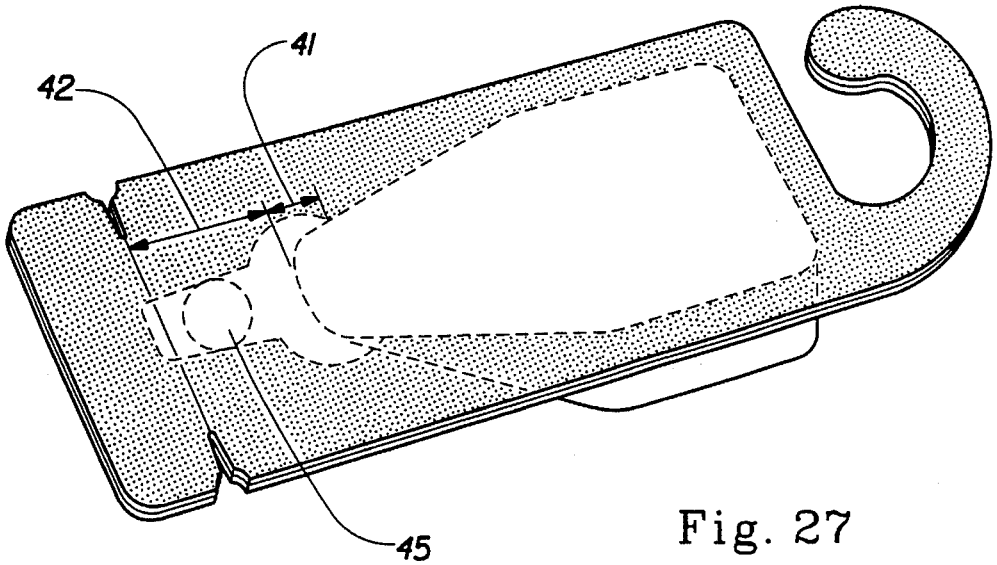

Each of FIGS. 26 and 27 is a perspective view of another package of the present invention.

Figure 28A:
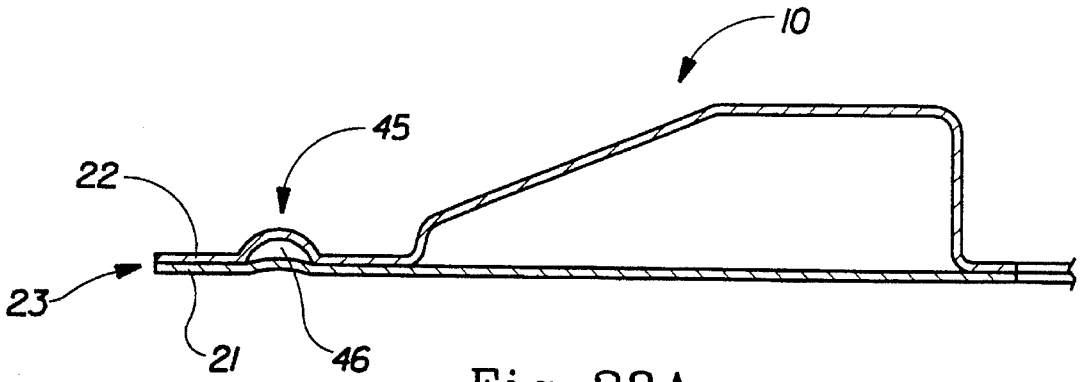

FIG. 28A is a cross sectional view along section line 28—28 of the package of FIG. 26 when a liquid path is opened.

Figure 28B:
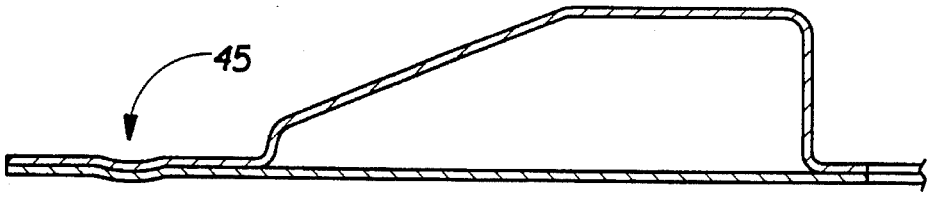

FIG. 28B is a cross sectional view along section line 28—28 of the package of FIG. 26 when the liquid path is closed.

Figure 29:
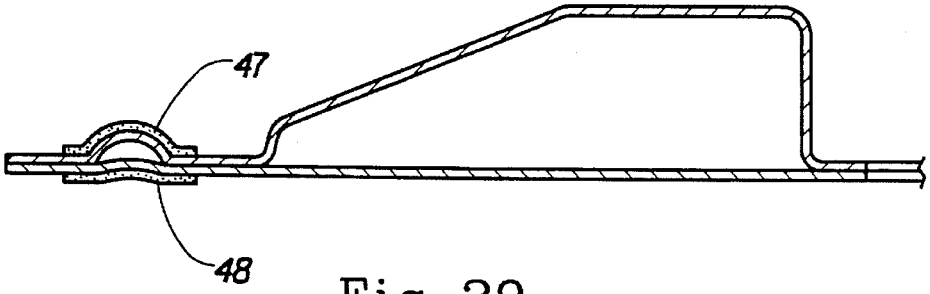

FIG. 29 is a cross sectional view of another package of the present invention.

Figure 30A:
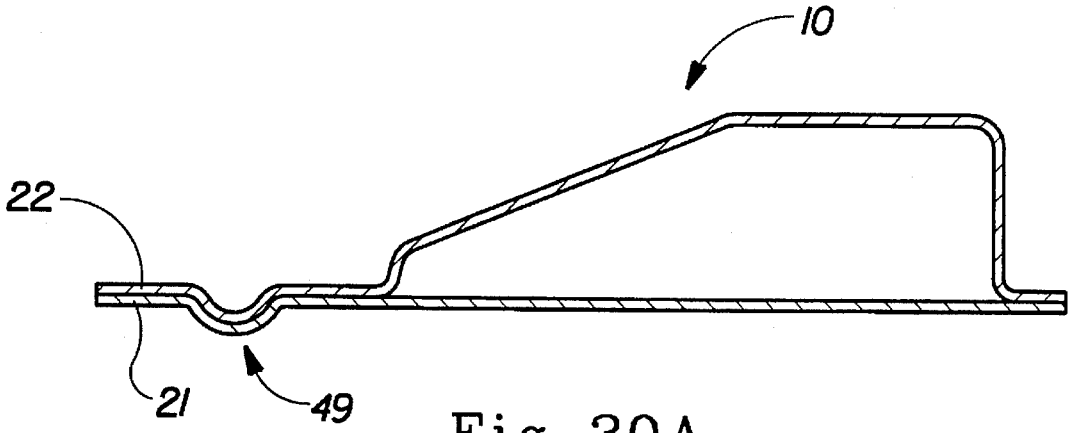

FIG. 30A is a cross sectional view of another package of the present invention when a liquid path is closed.

Figure 30B:
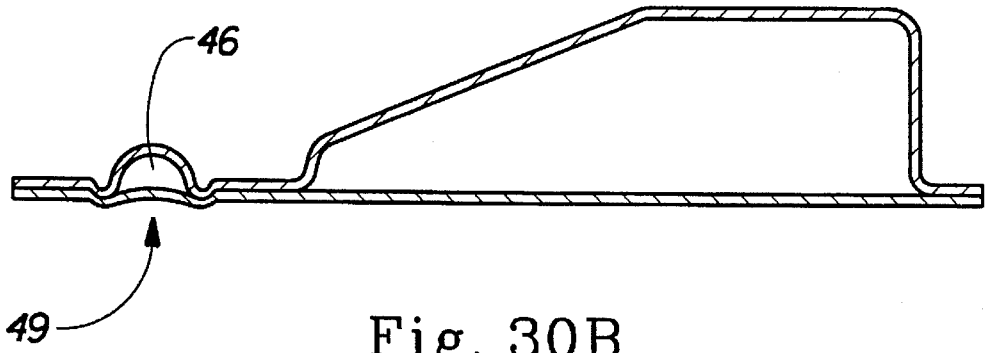

FIG. 30B is a cross sectional view of the package shown in FIG. 30A when the liquid path is opened.

Figure 31:
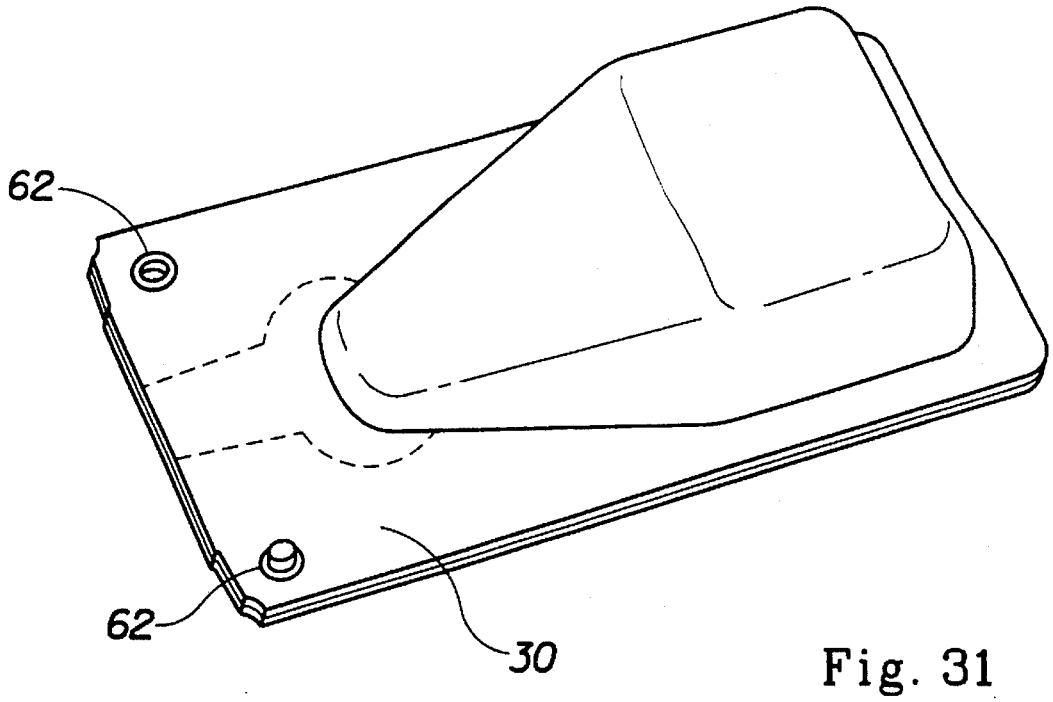

FIG. 31 is a perspective view of another package of the present invention.

Figure 32:
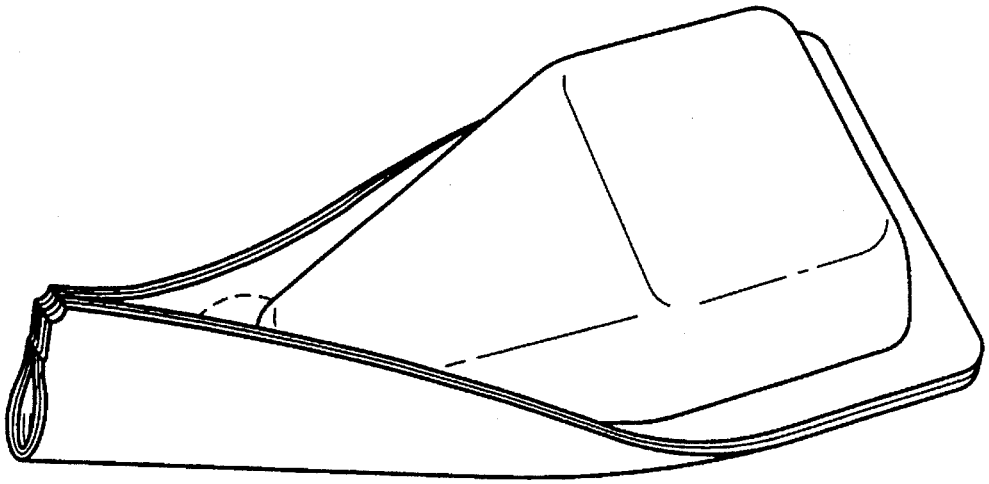

FIG. 32 is a perspective view of the package shown in FIG. 31 when snap buttons are engaged.

Figure 33:
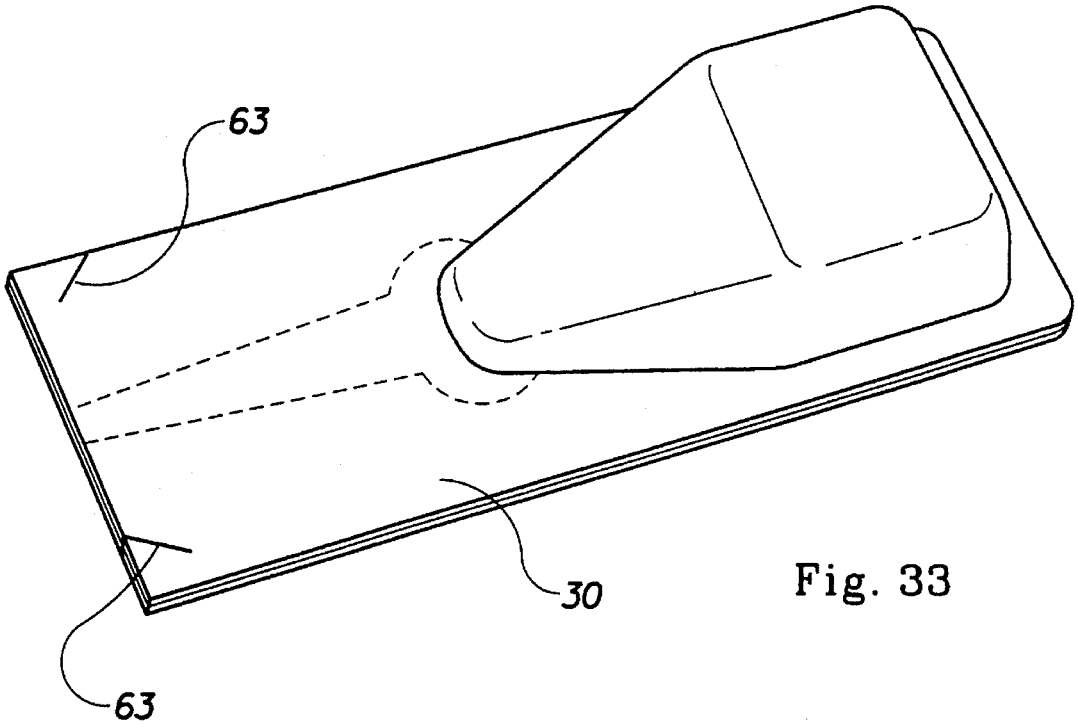

FIG. 33 is a perspective view of another package of the present invention.

Figure 34:
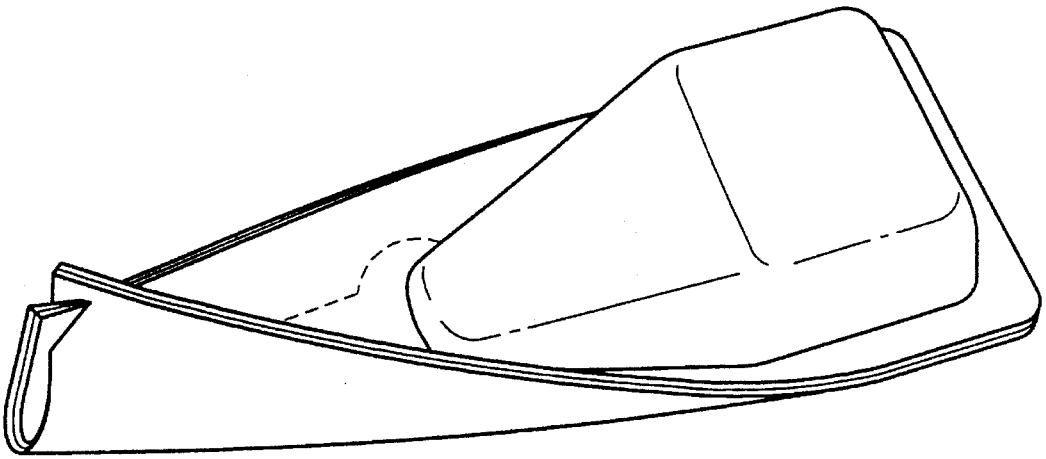

FIG. 34 is a perspective view of the package shown in FIG. 33 when cuts are engaged.

Figure 35:
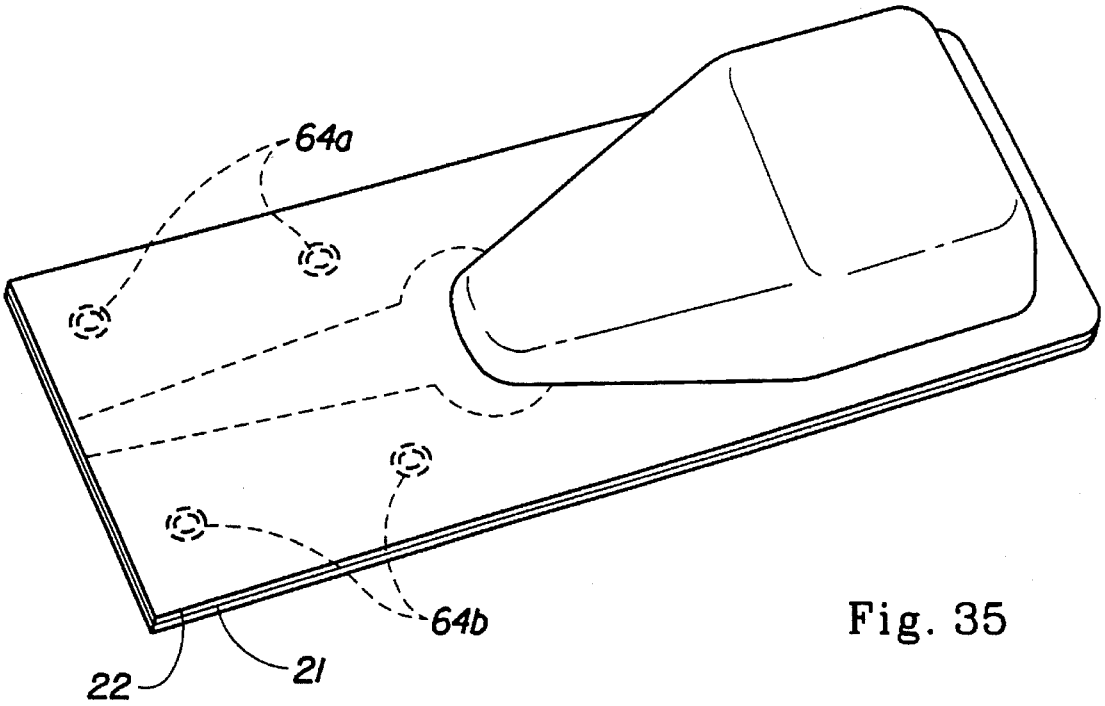

FIG. 35 is a perspective view of another package of the present invention.

Figure 36:
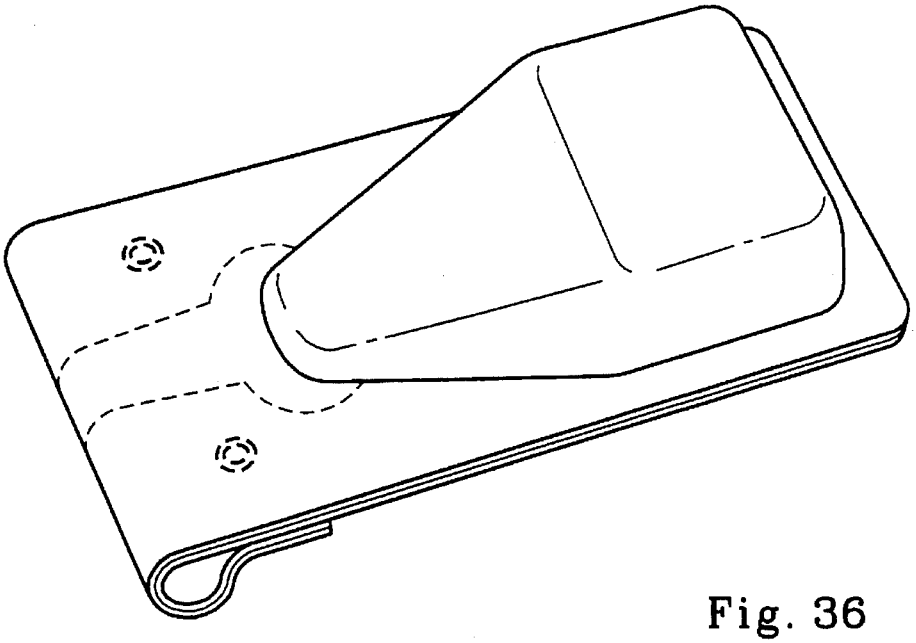

FIG. 36 is a perspective view of the package shown in FIG. 35 when snap buttons are engaged.

DETAIL DESCRIPTION OF THE INVENTION

Figure 1:
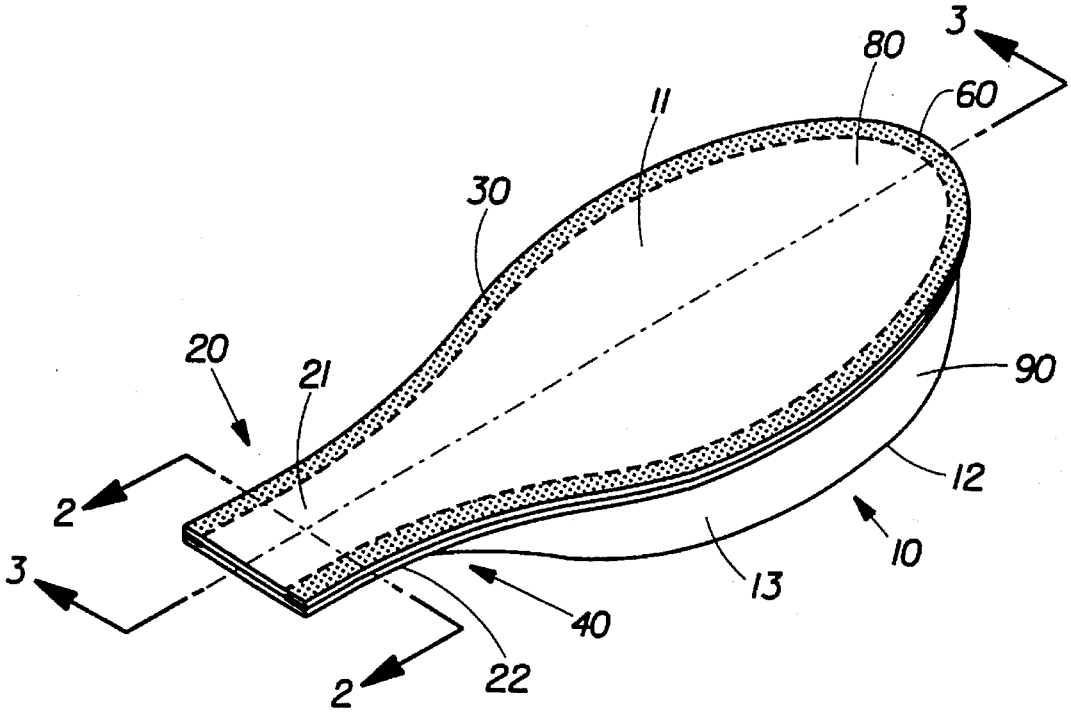
FIG. 1 is a perspective view of a package of the present invention.
Figure 2A:
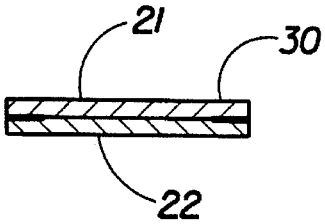
FIG. 2*a* is a cross sectional view along section line 2—2 of flat channel valve of FIG. 1 when the flat channel valve is in closed mode.

Referring to the Figures, there is shown in FIG. 1 a self-closing liquid dispensing package filled with liquid contents comprising a sealed liquid container 10 integral with and in liquid communication at a connection portion 40 with flat channel valve 20. The package of FIG. 1 is made of a first package member 80 and a second package member 90 which are sealed with each other along the perimeter seal 60. The first package member 80 serves as a cover 11 of the liquid container 10 and a first sheet member 21 of the flat channel valve 20. The second package member 90 comprises a reservoir portion 13 preferably in the form of a cup 12 to contain the quantity of liquid and defines the shape of the liquid container 10, and a second sheet member 22 at the flat channel valve 20. The first and second sheet members (21 and 22) of the flat channel valve 20 are indexed face-to-face as shown in FIG. 2*a*. The width of the seal 60 along the perimeter of the liquid container 10 and along the longitudinal edges of the flat channel valve 20 define a flange 30.

Figure 2B:
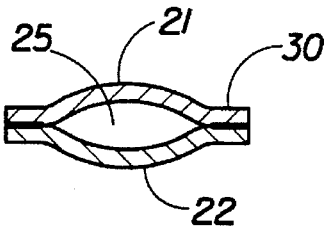
FIG. 2*b* is a cross sectional view along section line 2—2 of flat channel valve of FIG. 1 when the flat channel valve is in dispensing mode.

When pressure is applied to the liquid container 10 by manual squeezing force, the flat channel valve 20 is forced to arch away to provide a flow channel 25 as shown in FIG. 2*b*. The flow channel 25 thus provided dispenses the liquid out of the package from the mouth 23. When the squeezing is released, the first and second sheet members (21 and 22) return to their face-to-face indexed position, thereby closing the flat channel valve 20 to the original closed mode as shown in FIG. 2*a*.

Figure 3:
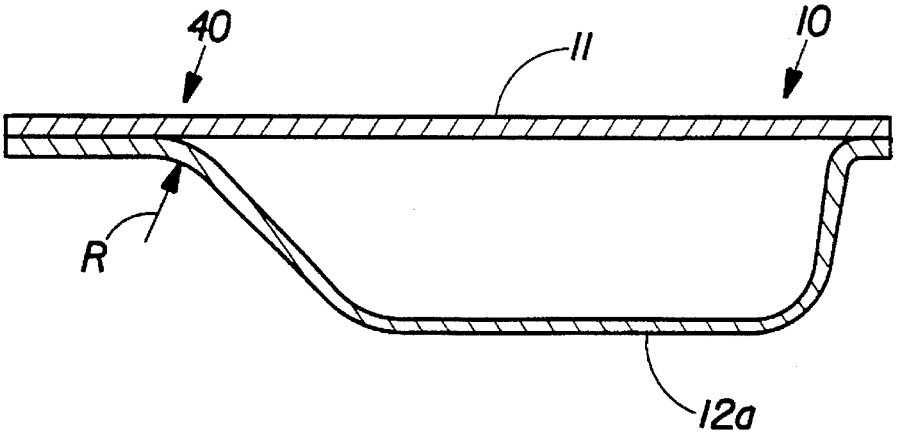
FIG. 3 is a cross sectional view along section line 3—3 of the package of FIG. 1.
Figure 11:
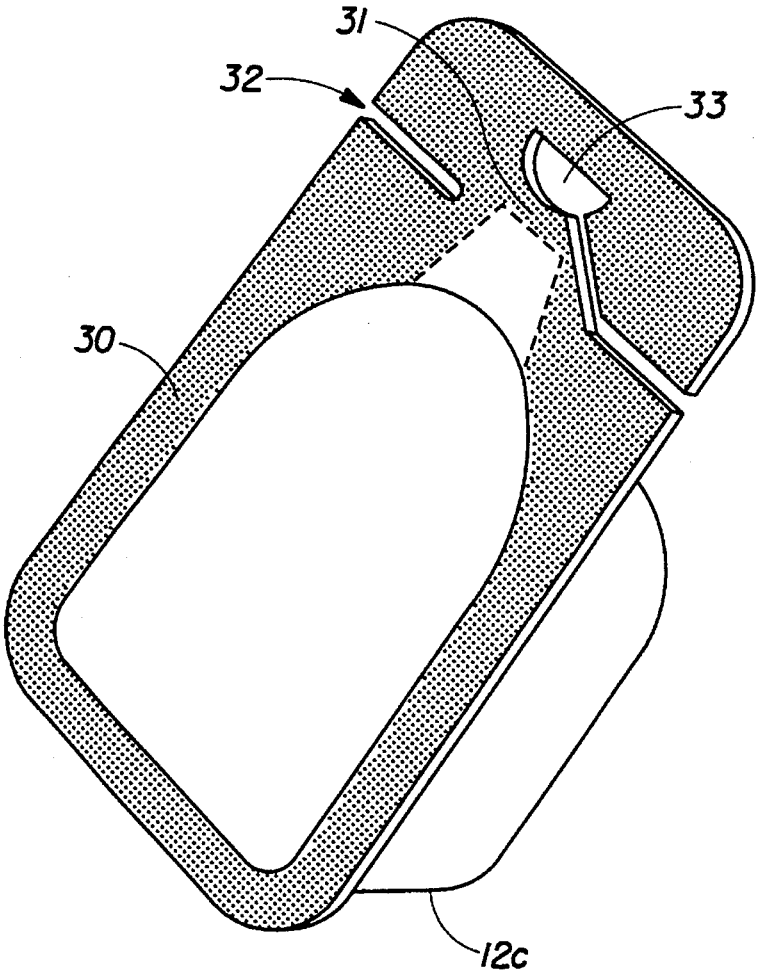
FIG. 11 is a perspective view of another package of the present invention having a liquid container capable of standing up, and also having a shipping seal, a pre-cut tearing notch, and a hanger.

The liquid container 10 of the present invention can be designed in any size and shape. Preferably, the size and shape is suitable for conveniently holding by one hand, and made of a suitably pliable material which can be manually squeezed to easily provide pressure to the liquid container 10 without tearing or ripping of the material. Preferably, the shape of the liquid container 10 enables the package to stand up on the surface 12*a* of the cup 12 which is parallel to the cover 11 as shown in FIG. 3. Another preferable shape of the liquid container 10 is one which enables the package to stand up on the surface 12*c* of the cup 12 as shown in FIG. 11.

In a most preferred embodiment, the flat channel valve 20 has an increased lateral width between the connection portion 40 and the mouth 23, for example, as shown in FIGS. 24 and 25. The increased lateral width of the flat channel valve 20 can conduct more amount of liquid from the liquid container 10 to the flow channel. The increased liquid helps to open the flow channel more largely by pushing the inner walls of the first and second sheet members 21, 22. This means that a user can dispense the liquid by applying a lower pressure. In the meantime, the increased lateral width structure can also promote the liquid flow back into the liquid container more easily. It should be noted that the flat channel valve 20 having an increased lateral width can be formed in any planar shapes such as trapezoid, triangle, square, irregular shape and the like.

The liquid container 10 of the present invention is preferably at least partially formed by thermoforming of thermoplastic material into the desired shape to provide a reservoir portion 13 for containing the quantity of liquid. Generally, thermoforming involves deformation of a substantially planar thermoplastic material into a three-dimensional form, such as the cup 12 shown in FIG. 3. Thermoforming requires that the substantially planar sheet material be heated to a certain temperature (the heat distortion temperature) at which the thermoplastic material can be permanently deformed. After the thermoplastic material is formed into the desired shape, the temperature is reduced below the heat distortion temperature, thereby establishing the shape. When thermoformed, the area of the planar thermoplastic material is extended, thus rendering the material which is extended to have less thickness than the original non-extended material. This extending increases the flexibility of the reservoir portion 13 of the liquid container 10 which receives much of the pressure upon squeezing. This increased flexibility makes the liquid container 10 easier to squeeze. In the meantime, the flange portion 30 remains relatively thick and stiff. Thermoforming is also advantageous in that the shape of the liquid container 10 can be easily designed to any desired shape.

Figure 4:
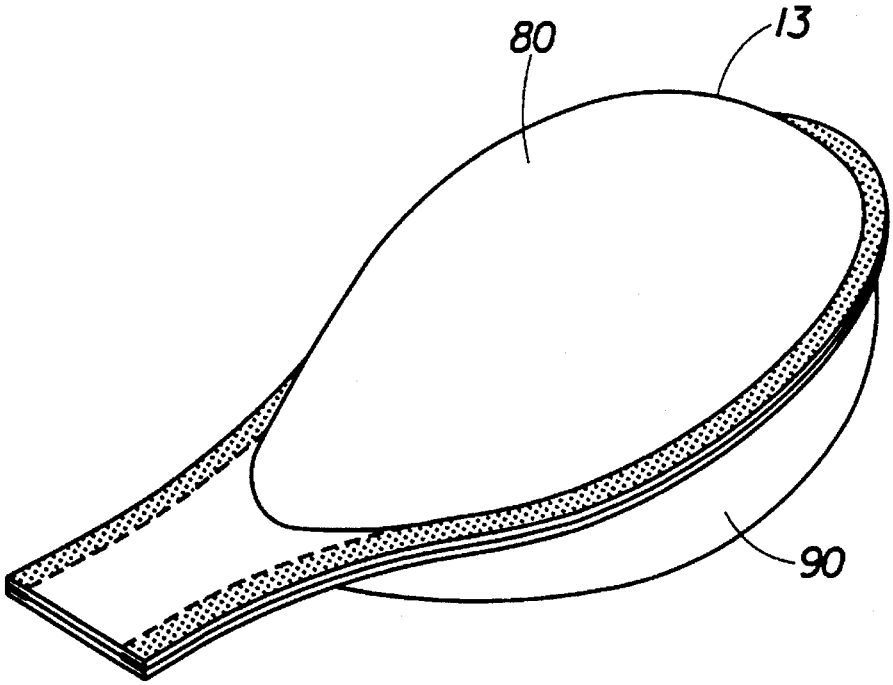
FIG. 4 is a perspective view of another package of the present invention having a liquid container which has reservoir portions on both package members.

Thermoforming can be applied to both the first package member 80 and second package member 90 to make a package having two reservoir portions 13 in the liquid container 10 as shown in FIG. 4. Such a package as shown in FIG. 4 is capable of containing a relatively large amount of liquid compared to a package comprising only one reservoir portion 13.

In a preferred embodiment of the present invention, the flat channel valve 20 is made of first and second sheet members (21 and 22) wherein at least one of said sheet members is sufficiently resilient to return said sheets to their original planar position when squeezing pressure which had been applied to the container 10 is released. This resilience provides improved closing of the flat channel valve 20. Material which is capable of rendering such resilience is selected for such sheet member. Such material is preferably a thermoplastic material, including mono-layer and laminated plastic films and sheets, such as polyethylene, polypropylene, polyvinyl chloride polystyrene, polyvinylydene chloride, fluoride resin, polycarbonates such as polymethylmethacrylate, esters such as polyethyl terephthalate, polyamides, polyphenylene oxides, and laminates with metal coating, and other liquid impervious material such as laminated carton is useful.

Generally, preferred thermoplastic material for the present invention have a thickness of at least 0.05 mm. One particularly preferred material is polypropylene. When polypropylene is used for making the package, it is preferred that at least one of the two sheet members have an average thickness of at least 0.1 mm, more preferably 0.15–0.3 mm. In one particularly preferred embodiment using polypropylene for dispensing liquid having about several thousand centipoises, one of the sheet member is 0.15 mm thick, while the other is 0.2–0.3 mm thick.

Although the flat channel valve 20 of the present invention can re-close itself, re-closing can also be assisted by the surface tension of liquid trapped between the first and second sheet members (21 and 22), particularly when liquid of low viscosity is contained. The flow channel of the flat channel valve 20 of the present invention preferably extends straight away from the liquid container 10, without any corners or bendings. In case the liquid to be contained has a high viscosity, the flat channel valve 20 preferably does not have corners or bendings.

The width, length, and ratio of width/length of the flat channel valve 20 of the present invention can be suitably changed according to the liquid to be contained in the package. The width of the flat channel valve 20 of the present invention is usually 5–30 mm. The flat channel valve 20 of the present invention can provide improved re-closing with a relatively short length with any kind of liquid, such as 3–10 mm, compared to pouch-type packages in the art. In case high viscosity liquids are contained, it is preferable that the width is relatively wider and length is relatively shorter.

Figure 5:
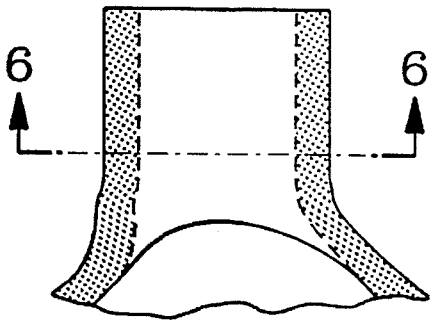
FIG. 5 is a cross sectional view of a straight flat channel valve of the present invention.
Figure 7:
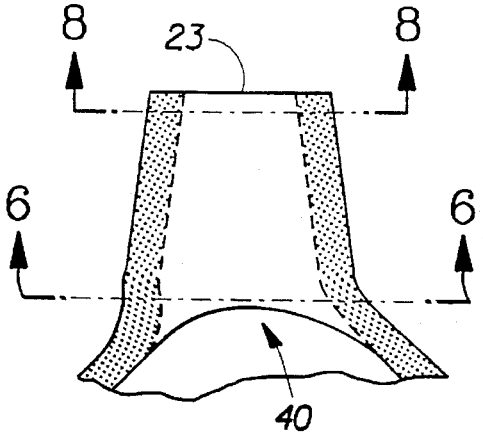
FIG. 7 is a cross sectional view of a trapezoid flat channel valve of the present invention.
Figure 6:
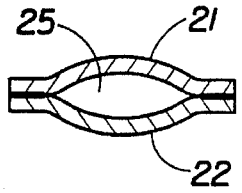
FIG. 6 is a cross sectional view along section line 6—6 of the flat channel valve of FIG. 5, and section line 6—6 of the flat channel valve of FIG. 7.
Figure 8:
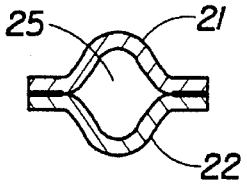
FIG. 8 is a cross sectional view along section line 8—8 of the flat channel valve of FIG. 7.

The plan view shape of the flat channel valve 20 can be square, rectangular, trapezoid, or rounded. In a highly preferred embodiment of the present invention, the lateral width of said flat channel valve 20 is greater at the connection portion 40 than at the mouth 23, thereby taking a trapezoid shape when seen in a plan view. Such a flat channel valve as shown in FIG. 7 provides excellent dispensing and re-closing. The flow channel 25 of the trapezoid flat channel valve 20 is required to open more vertically at the mouth 23 as shown in FIG. 8 than that at the connection portion 40 as shown in FIG. 6 to dispense a flow of liquid material. Without being bound by theory, it is believed that this vertically larger flow channel at the mouth 23 requires a greater force to achieve such shape, and thus, the flat channel valve 20 closes with stronger force at the mouth 23 than at the connection portion 40 of the flat channel valve 20 when the squeezing pressure is released. This facilitates flow of the liquid trapped in between the flat channel valve 20 to return to the liquid container 10. It is also believed that, because of the greater force needed to create the flow channel at the mouth 23, the closing of this trapezoid flat channel valve 20 is more effective than a flat channel valve 20 having the same width at the mouth 23 and connection portion 40 as shown in FIGS. 5 and 6.

Figure 9:
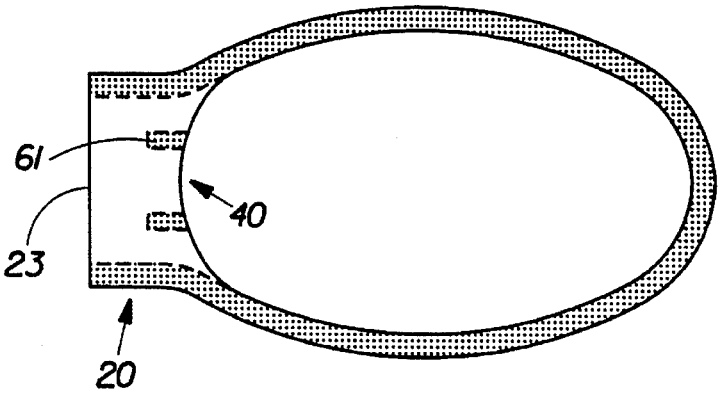
FIG. 9 is a sectional view of another package of the present invention having interposing seals.

The flat channel valve 20 can further comprise one or more additional interposing seal 61 as shown in FIG. 9. The interposing seal 61 can provide better flow control of liquids, and also facilitates re-closing action. The interposing seal 61 is particularly beneficial for liquids having higher viscosity. Liquids having high viscosity such as pastes and gels require more pressure to move through the flat channel valve 20 to provide a flow channel 25, compared to low viscosity liquids. As such, liquids having high viscosity are preferably contained in a package having a wide flat channel valve 20 for improved ease of dispensing. However, a wide flat channel valve 20 tends to have relatively slower re-closing action, and thus liquid may remain trapped in the flat channel valve 20. This interposing seal 61 provides quicker re-closing action, and so a wide flat channel valve 20 which provides a good re-closing action can be provided. The interposing seal 61 may be provided near the connection portion 40 of flat channel valve 20, but can also extend along the longitudinal length of the flat channel valve 20 from the connection portion 40 to the mouth 23.

Figure 10:
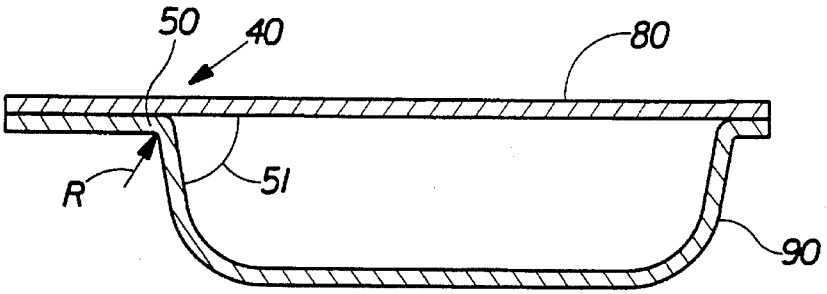
FIG. 10 is a sectional view of another package of the present invention having a connection portion comprising a stiffening crease.

The connection portion 40 is the boundary between the liquid container 10 and flat channel valve 20. The connection portion 40 can comprise a stiffening crease 50 against the flat channel valve 20 as shown in FIG. 10. The stiffening crease 50 is a distinct and substantially permanent folding line provided in at least one of the package members 80 or 90 which extends at least partially, preferably completely, across the lateral width of the flat channel valve 20. It is preferable that such stiffening crease has a small radius R (as shown in FIG. 10) rather than a large radius (as shown in FIG. 3). In a highly preferred embodiment, the radius of the stiffening crease is less than 1 mm.

The assistance of closing force provided by the stiffening crease 50 is enhanced as the stiffening crease 50 becomes more distinct by forming a greater angle 51 relative to the surface of the adjacent sheets of connection portion 40 as shown in FIG. 10. In a preferred embodiment, the connection portion 40 is so configured that such angle 51 is at least 5 degrees, more preferably of about 5 to 90 degrees. Re-closing action is improved as the angle increases toward 90 degrees.

The stiffening crease 50 can be constructed by folding means or thermoforming means. Thermoforming is a particularly preferred method for forming such stiffening crease 50. It is preferable that the connection portion 40 is structured and rigid. By providing a rigid stiffening crease 50, the configuration of the connection portion 40 remains substantially unchanged regardless of quantity of liquid remaining in the liquid container, and thus good re-closing is provided when liquid in the container is full as well as decreased.

The preferred flat channel valve wherein at least one of said sheets has certain resilient force, or wherein the connection portion comprises a stiffening crease 50, or the combination thereof, assists the re-closing action of the flat channel valve 20. Without being bound by theory, it is believed that, upon re-closing, the liquid remaining around the stiffening crease 50 would be forced back into the liquid container 10. The improved re-closing provided by the stiffening crease 50 also helps to prevent air from entering in the flow channel 25 from the atmosphere upon re-closing, and helps to draw inside liquid trapped in the flow channel 25 upon closing. This stiffening crease 50 provides the flat channel valve 20 of the present invention with improved closing force and re-closing compared with conventional packages having conventional flat channel valves of the same length. It is important that the inertia of flow of liquid is cut sharply, and liquid is forced back from the flat channel valve 20, since if liquid is left in the flat channel valve 20, liquid can gradually flow and leak out from mouth 23 after the flat channel valve 20 is re-closed. Preferably, when the package of the present invention is closed, there is a minimal amount of liquid remaining in the flat channel valve 20. Thus, the package of the present invention has minimum leakage once it is closed.

The flange 30 is defined by a seal 60 made where the first package member 80 is affixed together with the second package member 90. After sealing, the perimeter shape of the flange can be made by a cutting or stamping operation well known in the art. By adjusting the sealing and stamping process, the flange 30 can be designed to provide various additional functional means to the package.

Figure 12:
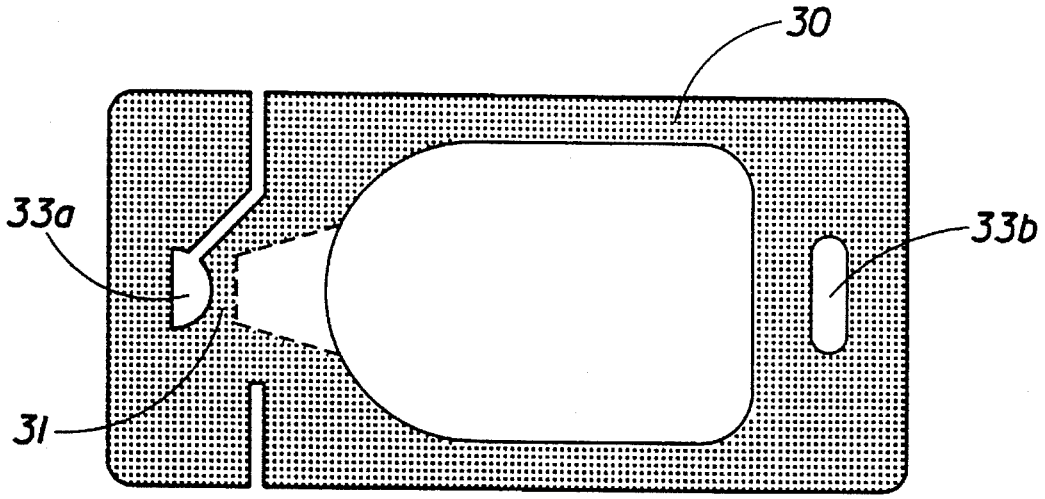
FIG. 12 is a sectional view of another package of the present invention having a shipping seal, a pre-cut tearing notch, a first hanger at the end of the flat channel valve, and a second hanger at the end of the liquid container.
Figure 13:
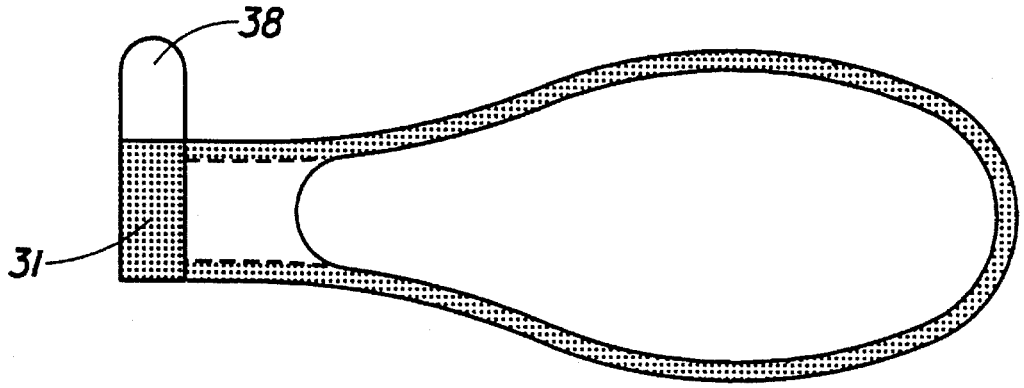
FIG. 13 is a sectional view of another package of the present invention having a tab.

The flange 30 can extend longitudinally along the sides of the flat channel valve 20 and laterally at the distal end of the flat channel valve 20 to interconnect out board of the mouth 23 of the flat channel valve 20 to form a shipping seal 31. To remove the shipping seal, any one of a variety of well known opening means can be used. For example, a pre-cut notch 32 can be provided at the longitudinal sides of the flat channel valve 10 so that the consumer can open the shipping seal 31 by tearing or cutting across the width of the flat channel valve 20 to provide a mouth 23 (FIGS. 11 and 12). A tab 38 can be provided by extending laterally from one of the first or second package members (80 or 90) at the shipping seal 31 as shown in FIG. 13. A groove or score line can be provided to a partial depth of either sheet by mechanical or laser cutting, or scoring. Coextruded material having a certain weak joint can be utilized. Laminated sheets having sublayer perforation can be utilized for ease of tearing. It is preferable that such laminated sheet is not thermoformed, since the perforation can be destroyed by heating, Monoaxially oriented sheets can be utilized by placing them in a direction parallel to the tearing direction. Such monoaxially oriented sheet is also preferably not thermoformed, for these sheets are known to expand irregularly when heated. The tearing means thus mentioned can be used solely or in combination. These tearing means are usually provided so that, by tearing the seal off, a flat channel valve 20 of the designated length having a mouth 23 is provided.

The shipping seal 31 can further extend in the longitudinal direction of the flat channel valve 20 to provide a suspensory means such as a hanger 33 as shown in FIGS. 11 and 12. Likewise, the flange 30 adjacent to the fluid container 10 can also be extended and provided with a suspensory means. The package of FIG. 12 is provided with a first hanger 33*a* which is useful for displaying prior to use, and a second hanger 33*b* which is useful for hanging the package upon use.

Figure 14:
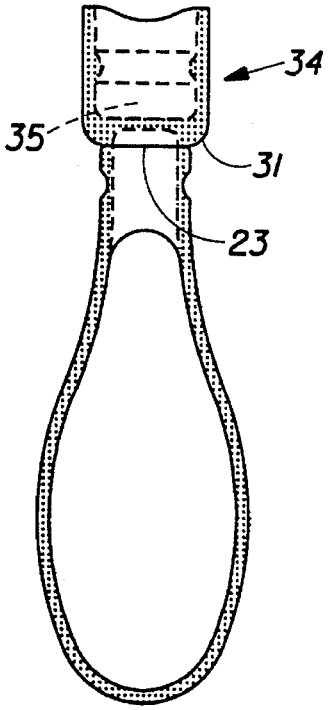
FIG. 14 is a sectional view of another package of the present invention having a cap.
Figure 15:
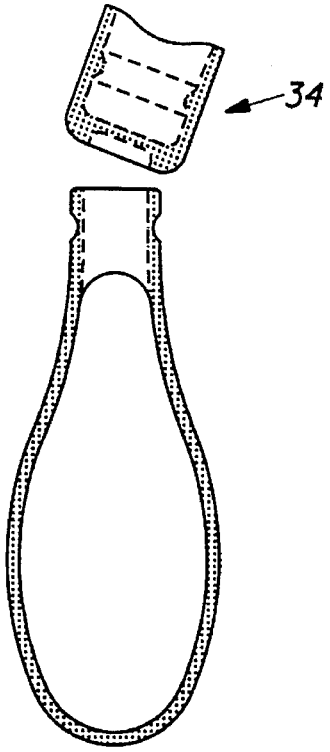
FIG. 15 is a sectional view of the package of FIG. 14 wherein the cap has been torn off from the package.
Figure 16:
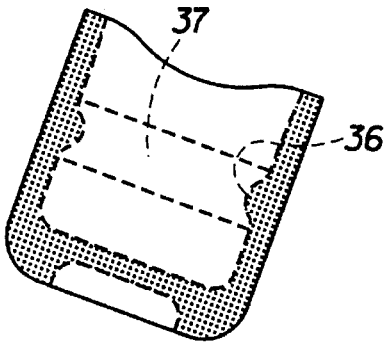
FIG. 16 is an enlarged sectional view of the cap of FIG. 15 which has been torn off.
Figure 17:
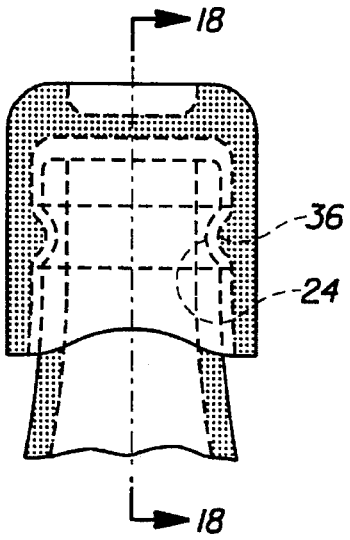
FIG. 17 is a partial enlarged sectional view of the package of FIG. 14 wherein the cap has covered the flat channel valve.
Figure 18:
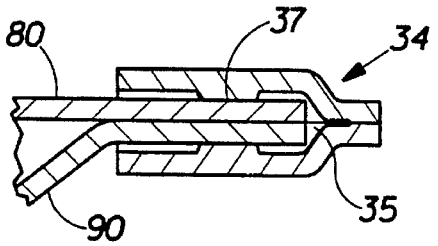
FIG. 18 is a cross sectional view along section line 18—18 of the package of FIG. 17.

Alternatively, the flange 30 can be extended and configured to provide a capping means. As shown in FIG. 14, a cap 34 can be made as an integral extended portion of the shipping seal 31 of the flat channel valve 20. The cap 34 is made to have a cavity portion 35 in the extended flange 30, which cavity portion 35 conforms with the shape of the exterior of the flat channel valve 20 as shown in FIG. 17. Preferably, the cap is formed from the two package members 80 and 90 extending outboard the mouth 23. The cap 34 can be torn off from the flat channel valve 10 as shown in FIG. 15. In a particularly preferred embodiment, the cap 34 is provided with one or more projection 36 which matches with one or more indent 24 along the longitudinal edge of the flat channel valve 20 to improve secure capping as shown in FIG. 17. For further secure capping, a projection line 37 can be provided to the inside of the cap 34 as shown in FIG. 18. A capping means can also be interconnected to the package, preferably to the liquid container, via a cap connecting member.

In a further preferred embodiment, the liquid container 10 is formed by thermoforming as shown in FIGS. 20 to 22. The lateral width and height of the liquid container 10 are decreased towards the connection portion 40. This shape enables users to grasp the liquid container 10 more easily and to dispense the liquid with a minimum pool left in the liquid container 10.

As shown in FIG. 20, there are cuts 39*a* and a score line 39*b* provided on the flange 30. The score line 39*b* is formed in at least one of the sheet members 21, 22. More specifically, at least one of the sheet members 21, 22 has the score line 39*b* formed therein for assisting a user to make a dispensing outlet (or mouth) in the self-closing flat channel valve 20. Preferably, a mono-axial material oriented toward the score line 39*b* is used for at least one of the sheet members 21, 22. Therefore, the shipping seal 30 can be removed by manual easily before the use.

In use, the liquid dispensing package shown in FIG. 20 is usually grasped and pressed by a hand in the manner shown in FIG. 23. Consequently, the flange 30 and the flat channel valve 20 have a tendency to be bent undesirably during dispensing. Since the bend of the flat channel valve 20 forces the flow channel to close or choke, the user is potentially required to press the reservoir portion more strongly in order to dispense the liquid. This means that the bend of the flat channel valve 20 may cause difficulty in usage.

The improved flat channel valve having an increased lateral width of the invention can prevent this potential problem. More specifically, the improved valve has an increased lateral width portion compared with the lateral width at the inlet of the flat channel valve. Since the increased amount of liquid flowing the flow channel pushes more strongly the inner walls of the flow channel, the flow channel can be prevented from closing or choking even if the flat channel valve is bent by a hand. In other words, users can dispense the liquid without applying so strong pressure to the liquid container 10.

In a most preferred embodiment of the invention shown in FIGS. 24 and 25, the flat channel valve 20 has an increased lateral width near the connection portion 40 and a decreasing lateral width near the mouth (not shown). Referring to FIG. 25, the increasing section 41 is started from the position at which the edge of the flat channel valve 40 is first connected to the liquid container 10, and ended at the position of the top of the liquid container 10. The decreasing section 42 is started from the top of the liquid container 10, and ended at the mouth (not shown).

In the increasing section 41, the lateral width W1 of the flat channel valve 20 is at least partially increased compared with the lateral width W0 at the starting edge of the flat channel valve 20. More preferably, the width W1 is greater than the width W0 in the whole section 41. Most preferably, the width W1 is gradually changed on a curved line as shown in FIG. 25.

In use, after the shipping seal 31 is removed, the liquid dispensing package is grasped and pressed, for example, as shown in FIG. 23. In this package, although the flat channel valve 20 is also bent, the broader flow channel can be easily opened and maintained in the increasing section 41. Therefore, the user can dispense the liquid without pressing the liquid container 10 so strongly. This means that easy dispense can be obtained from the embodiment shown in FIGS. 24 and 25.

As described before, the flow channel of the self-closing liquid dispensing package of the present invention can be closed spontaneously by stopping pressing the liquid container 10, however; there is a need to close the flow channel more tightly. This need is dependent on the circumstances how the self-closing liquid dispensing package is brought. For example, when a user brings the package in a bag after removing the shipping seal 31, a leakage of liquid may be caused by the undesirable application of pressure to the liquid container 10. Therefore, there is a need to prevent the flat channel valve 20 from the undesirable leak.

In preferred embodiments of the invention, the self-closing liquid dispensing package further comprises a closure ensuring means for ensuring the closure of the flow channel. In a preferred embodiments, the closure ensuring means is a liquid flow gate formed on and/or in the flow channel of the flat channel valve 20. Users can control the closure of the flow channel by manually pressing the liquid flow gate. When the liquid flow gate is in an opening position, users can dispense the liquid by squeezing the liquid container 10. On the other hand, when the liquid flow gate is in a closing position, the flow channel can be closed more tightly thereby causing no leakage of the leakage.

Referring to FIG. 26, the liquid flow gate is a gate button 45 in the decreasing section 42 of the flat channel valve 20. The gate button 45 has a specific cross-sectional structure as shown in FIG. 28A. In the flat channel valve 20, the second sheet member 22 is concaved in the form of hemisphere thereby forming an opened structure i.e. a liquid path 46 in the gate button 45. In this state, the gate button 45 is in the opening position. Therefore, users can dispense the liquid through the liquid path 46 by pressing the liquid container 10.

On the other hand, when the package is not used and/or the leakage of liquid must be prevented, the gate button 45 is pushed down by manual to the closing position thereby forming a closed structure of the gate button 45 as shown in FIG. 28B. This structure prevents the flat channel valve 20 from leaking the liquid even if a pressure is applied to the liquid container 10.

In a preferred embodiment, the gate button 45 is covered by reinforce materials 47, 48 as shown in FIG. 29.

In an alternative preferred embodiment shown in FIGS. 30A and 30B, there is a gate button 49 having the first sheet member 21 concaved to close the flow channel. In this state, the gate button 49 is in the closing position. Before pushing up the gate button 49, the flow channel is not formed even if a pressure is applied to the liquid container 10. By pushing up the gate button 49 to the opening position, a liquid path 46 is formed between the first and second sheet members 21, 22 as shown in FIG. 30B. Therefore, users can dispense the liquid through the gate button 49. More preferably, the pushed gate button 49 is returned automatically to the initial closing position shown in FIG. 30A by the action of the elasticity of the sheet members 21, 22.

The gate buttons 45, 49 can be made of any elastic materials. Preferably the same material as the first and second sheet members 21, 22, i.e. a thermoplastic material is used. More preferably, the gate buttons 21, 22 and the flat channel value 20 can be made of a thermoplastic material and formed in a thermoforming process.

The gate button can take any planar shape such as circle, ellipse, trapezoid, triangle, square, irregular shape and the like. Preferably, the gate button is formed in the planar shape of circle or ellipse as shown in FIG. 26.

In preferred embodiments, the lateral width of the gate buttons can be selected in the range from about the same lateral width of the flow channel to about ten times the lateral width of the flow channel. More preferably, the lateral width of the gate buttons are from 1.2 to 2.0 times the lateral width of the flow channel.

The leakage problem can also be-solved by another closure ensuring means provided in the self-closing liquid dispensing packages of the invention. In preferred embodiments, the closure ensuring means comprises a means for maintaining the self-closing flat channel valve to be bent. In more preferred embodiments, the maintaining means is a fixing means for fixing the self-closing flat channel value 20 to be bent. In a preferred embodiment shown in FIGS. 31 and 32, the fixing means is a set of snap buttons 62 formed on the second package member 90 in the flange 30. In order to prevent the flat channel valve 20 from leaking, the snap buttons 62 are engaged together as shown in FIG. 32, thereby fixing the flat channel valve 20 to be bent. Since the bend of the flat channel valve 20 helps the closure of the flow channel in the flat channel valve 20, the leakage of liquid can be prevented more tightly.

In a more preferred embodiment, the fixing means is a couple of cuts formed near the comers of flange 30 as shown in FIG. 33. The cuts are also engaged together as shown in FIG. 34, thereby fixing the flat channel valve 20 to be bent. As a result, the leakage of liquid can be also prevented.

In an alternative preferred embodiment, shown in FIGS. 35 and 36, two sets of snap buttons 64*a*, 64*b* are provided on the first sheet member 21 as the fixing means. Each of the two corresponding buttons 64*a*, 64*b* are engaged together as shown in FIG. 35. Therefore, the flat channel valve 20 is forced to be bent and maintained, as a result, the leakage of liquid can also be prevented.

In yet another and alternative embodiment, the closure ensuring means is a cap means for caping the outlet of the flow channel. It should be noted that one non-limited example is shown in FIGS. 14 to 18 as the cap 34.

In the process of making a package of the present invention, thermoforming means is utilized. Thermoforming is the means of shaping thermoplastic sheets into a structured shape through application of heat and force. Such sheets useful for the pliable material of the present invention are made of mono-layer and laminated plastic films and sheets made of material such as polyethylene, polypropylene, polyvinyl chloride polystyrene, polyvinylydene chloride, fluoride resin, polycarbonates such as polymethylmethacrylate, esters such as polyethyl terephthalate, polyamides, polyphenylene oxides, and laminates of polyester and a heat seal coating. Polyethylene, polypropylene, polyvinyl chloride and multi-layer structures formed by lamination and/or extrusion thereof are most preferred. In a preferred embodiment, in order to improve gas sealing, a protection layer is provided on the top side and/or bottom side of the thermoplastic sheets. The protection layer works as a gas barrier to improve perfume and/or to prevent oxidation of the sheets. Preferably, nylons (Polyamides), ethylene/vinyl alcohol copolymers (EVOH), and Barex® is used as the protection layer. The Barex® is the trade name for a material made by Vistron Division of Standard Oil of Ohio in the U.S. It is made by copolymerising a 75:25 mixture of acrylonitrile and methyl acrylate in the presence of a small amount of a butadiene/acrylonitrile elastomer. The type of material selected will depend on variables such as the chemical composition, specific gravity, surface tension, and viscosity of the liquid product to be filled. The thickness of the sheet which is used to thermoform the package is selected depending upon the type of plastic and the amount of flexibility and resilience desired. Preferably, the material should have certain rigidness so that the flat channel valve 20 retains certain resilient force. Also preferably, the material is selected so as to provide certain flexibility to the reservoir portion 13 of the liquid container 10 where the material is extended by thermoforming.

Figure 19:
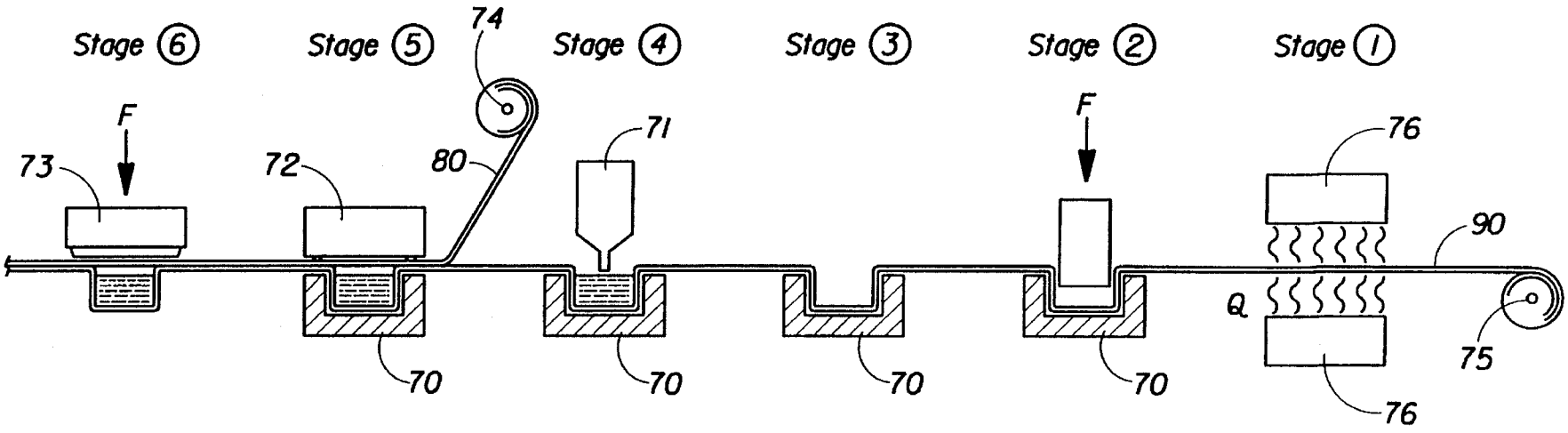
FIG. 19 illustrates a process for making a package of the present invention.

FIG. 19 illustrates a particularly preferred method for providing a package of the present invention. In this method, a portion of the second package member 90 is formed into a cup 12 which serves as a reservoir portion 13 leaving a portion un-thermoformed 14. The first package member 80 becomes the cover 11 of the liquid container 10 and matches with the un-thermoformed portion 14 of the second package member 90 to make a flat channel valve 20.

Specifically, the thermoforming process is used to make products from thermoplastic material by a sequence of heating, shaping, cooling, filling, sealing, and stamping stages as shown in FIG. 19. In the first stage, the second package member 90 is heated by a heating means 76 beyond the deformation temperature of the thermoplastic material. In the second stage, a vacuum, for example, pulls the heated, softened second package member 90 into a mold 70. The cup 12 can be designed by the mold 70 into a shape depending on the needs and convenience. It is this mold 70 or concave surface that produces package shape and surface detail. In the third stage, the heat-softened second package member 90 assumes the shape by being forced against the mold 70 until it cools below the deformation temperature and sets up. The cup 12 is left to cool further to a temperature which would not deteriorate the product to be filled. The reservoir portion 13 of the second package member 90 thus extended by this process has less thickness than its original thickness. In the fourth stage, the second package member 90 emerges with the cup 12 formed and ready to accept a product. The liquid product is then filled from a filler 71 into the cup 12 of the second package member 90. In the fifth stage, the first package member 80 is indexed over the second package member 90 and the two sheets are sealed by a sealer 72. The first package member 80 can be made from the same thermoplastic material as the second package member, or a different material. The sealing can be made in any manner known to those skilled in the art which is suitable for the first and second package members, such as heat sealing, induction sealing, and sealing by adhesives. For packaging of liquid products such as food and medicine, evacuation, and if needed, gas injection can be performed at this stage.

Generally, the surfaces of the first package member 80 and second package member 90 extending from the seal 60 of the perimeter of the fluid container 10 and flat channel valve 20 are sealed together. This sealed area defines the flange 30. The flange 30 extending from the flat channel valve 20 portion can be sealed to make a designed surface and a shipping seal 31. Last, the perimeter of the obtained package is as stamped out and/or trimmed off 73 to make the desired final shape of the package. At this process, the flange 30 portion of the package can be stamped to make a sealing means, tearing means, suspensory means, or capping means. The surface of the first package member 80 then can be printed and labeled.

This sequence of processes for providing a package of the present invention using thermoforming can be provided in a continuous flow-production. The first and second package members (80 and 90) are rolled out by unwinding rollers 74 and 75, respectively.

The package thus obtained by thermoforming can have a resilient flat channel valve 20, a distinctive structured connection portion 40, and a thinner flexible liquid container 10 which is collapsible. By taking such configuration, the package can retain the shape of the connection portion 40 as the contained liquid decreases, whereas the liquid container 10 can be gradually collapsed. The package of the present invention is so configured to avoid air entering the package upon re-closing. As such, as the contained liquid decreases, the liquid container 10 will collapse without substantially affecting dispensing and re-closing performance. The improved re-closing feature, or re-closability, of the package also helps the collapsibility of the liquid container. Thus, nearly complete dispensing of the contained liquid ,can be made without substantial messiness.

The self-closing liquid dispensing package of the present invention works effectively for liquid products having a wide range of viscosity. The package is particularly useful for multiple-use disposable packages containing liquid product of about 20–70 ml volume. Non-limiting examples of such liquid products are: cosmetic products such as shampoo, conditioner, shower and shaving gels, shower and bath oil, body lotion, moisturizing cream, cleansing products such as dishwashing detergent, liquid hand soap, tooth paste, liquid laundry detergent, stain remover, liquid automotive products such as windshield-washer liquid, food products such as ketchup, mustard, salad dressing, jelly, fruit juice, soft drinks, mineral water, health care products such as liquid medicine, toothpaste, and stationery products such as glue.

We claim:

1. A self-closing liquid dispensing package comprising:

a) a liquid container, said liquid container having a thermoformed reservoir portion for containing liquid; and b) a self-closing flat channel valve in liquid communication with said liquid container, said flat channel valve comprising a first sheet member and a second sheet member, said first and second sheet members having longitudinal edges and being indexed face-to-face and sealed together along said longitudinal edges, said first and second sheet members having an original planar position, said first and second sheet members also being sufficiently flexible to arch away from each other to form a flow channel therebetween to permit a flow of liquid from said liquid container in response to external pressure applied to said liquid container, wherein at least one of said first and second sheet members has a thickness of at least 0.05 mm and at least one of said first and second sheet members is sufficiently resilient to return said first and second sheet members to their original planar position when said external pressure is released, and wherein said flat channel valve comprises an inlet adjacent to said liquid container and a mouth for dispensing liquid, a lateral width of said inlet being greater than a lateral width of said mouth, and said self-closing flat channel valve having an additional portion between said inlet and said mouth which has a lateral width greater than said lateral width at said inlet and said lateral width at said mouth.

2. The self-closing liquid dispensing package according to claim 1 wherein said first sheet portion is a cover portion for said reservoir portion, and said second sheet member has said reservoir portion therein, said first and second sheet members being sealed together along a perimeter of said reservoir portion and along said longitudinal edges to form a flange.

3. The self-closing liquid dispensing package according to claim 2 wherein said flange is extended longitudinally along sides of said self-closing flat channel valve and laterally at a distal end of said self-closing flat channel valve to interconnect to provide a sealing means to said self-closing flat channel valve.

4. The self-closing liquid dispensing package according to claim 1 further comprising a suspensory means.

5. The self-closing liquid dispensing package according to claim 1 wherein at least one of said first and second sheet members has a score line formed therein for assisting a user to make a dispensing outlet in said self-closing flat channel valve.

6. The self-closing liquid dispensing package according to claim 1 wherein the re-closability of said self-closing flat channel valve and flexibility of said reservoir portion provides collapsibility of said liquid container.

7. A self-closing liquid dispensing package comprising:

a) a liquid container; and b) a self-closing flat channel valve having an inlet adjacent to and in liquid communication with said liquid container, and a mouth, comprising a first sheet member and a second sheet member wherein said first and second sheet members have an original planar position and longitudinal edges, are indexed face-to-face, and are sealed together along said longitudinal edges, wherein said first and second sheet members are sufficiently flexible to arch away from each other to form a flow channel therebetween to permit a flow of contained liquid in response to external pressure applied to said liquid container, and wherein at least one of said sheet members is sufficiently resilient to return said first and second sheet members to said original planar position when said external pressure is released, and wherein, a lateral width of said inlet is greater than a lateral width of said mouth, and said self-closing flat channel valve has an additional portion between said inlet and said mouth which has a lateral width greater than said lateral width of said inlet and said lateral width of said mouth.

* * * * *

UNITED STATES PATENT AND TRADEMARK OFFICE

CERTIFICATE OF CORRECTION

PATENT NO. : 5,529,224
DATED : June 25, 1996
INVENTOR(S) : John G. Chan et al.

It is certified that error appears in the above-identified patent and that said Letters Patent is hereby corrected as shown below:

Title page,
Related U.S. Application Data, "Nov.3 1993," should read -- Nov. 1, 1993, --.

Column 1,
Line 8, "Nov. 3, 1993," should read -- Nov. 1, 1993, --.

Signed and Sealed this

Fourth Day of December, 2001

*Attest:*

Nicholas P. Godici

NICHOLAS P. GODICI
*Acting Director of the United States Patent and Trademark Office*

*Attesting Officer*